US007702112B2

(12) United States Patent
Obranovich et al.

(10) Patent No.: US 7,702,112 B2
(45) **Date of Patent: *Apr. 20, 2010**

(54) INTELLIGIBILITY MEASUREMENT OF AUDIO ANNOUNCEMENT SYSTEMS

(75) Inventors: Charles R. Obranovich, Blaine, MN (US); Philip J. Zumsteg, Shorewood, MN (US); Andrew G. Berezowski, Wallingford, CT (US); Walter Heimerdinger, Minneapolis, MN (US); John A. Phelps, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 1566 days.

This patent is subject to a terminal disclaimer.

(21) Appl. No.: 10/740,200

(22) Filed: Dec. 18, 2003

(65) Prior Publication Data

US 2005/0135637 A1 Jun. 23, 2005

(51) Int. Cl.
*H04R 29/00* (2006.01)

(52) U.S. Cl. ..... 381/58; 381/56; 381/77; 381/80; 381/82; 367/136; 704/270

(58) Field of Classification Search ..... 381/82, 381/92, 56–57, 58–59, 77, 80; 367/136; 704/228, 270

See application file for complete search history.

(56) References Cited

U.S. PATENT DOCUMENTS

| | | | | |
|---|---|---|---|---|
| 4,035,589 | A | 7/1977 | Parke | |
| 4,442,323 | A | 4/1984 | Yoshida et al. | |
| 5,119,428 | A | 6/1992 | Prinssen | |
| 5,635,903 | A * | 6/1997 | Koike et al. | 340/441 |
| 5,663,714 | A | 9/1997 | Fray | |
| 6,363,156 | B1 * | 3/2002 | Roddy | 381/86 |
| 6,473,509 | B2 * | 10/2002 | Albus et al. | 381/71.4 |
| 6,760,451 | B1 * | 7/2004 | Craven et al. | 381/98 |
| 6,792,404 | B2 * | 9/2004 | Jacob | 704/228 |
| 7,127,070 | B2 * | 10/2006 | Kimura et al. | 381/56 |
| 7,136,494 | B2 * | 11/2006 | Watson et al. | 381/86 |
| 2002/0015502 | A1 * | 2/2002 | Albus et al. | 381/86 |
| 2002/0099551 | A1 * | 7/2002 | Jacob | 704/270 |

(Continued)

FOREIGN PATENT DOCUMENTS

| | | |
|---|---|---|
| GB | 2 211 685 | 7/1989 |

(Continued)

OTHER PUBLICATIONS

International Search Report for International Application No. PCT/USO4/34646; dated Mar. 18, 2005 and Written Opinion of Intl. Searching Authority (4 pages).

(Continued)

*Primary Examiner*—Xu Mei
*Assistant Examiner*—Disler Paul
(74) *Attorney, Agent, or Firm*—Husch Blackwell Sanders Welsh & Katz

(57) ABSTRACT

A measurement system and method combine an audio announcement system with a plurality of spaced apart sensors to evaluate intelligibility of audio output from loudspeakers of the audio announcement system. Processing can take place at some or all of the sensors as well as at a common control element. Evaluations can be based on use of an appropriate speech intelligibility index method.

32 Claims, 2 Drawing Sheets

U.S. PATENT DOCUMENTS

| | | | | |
|---|---|---|---|---|
| 2002/0107692 | A1 | 8/2002 | Litovsky | 704/270 |
| 2002/0141601 | A1* | 10/2002 | Finn et al. | 381/92 |
| 2003/0021188 | A1* | 1/2003 | Baranek et al. | 367/136 |
| 2003/0128850 | A1* | 7/2003 | Kimura et al. | 381/82 |
| 2004/0004546 | A1* | 1/2004 | Ando et al. | 340/541 |
| 2005/0105743 | A1* | 5/2005 | Faltesek et al. | 381/82 |

FOREIGN PATENT DOCUMENTS

| | | |
|---|---|---|
| WO | WO 03/055112 | 7/2003 |

OTHER PUBLICATIONS

Steele, Mike, Sr., "The Speech Transmission Index Program is Up and Running", Press Release, Research Division Lexington Center, 11 pgs., Sep. 2003.

SimplexGrinnell and Gold Line Jointly Announce a New Technology for Complying with Fire Alarm Voice Intelligibility Requirements, STI Product Information Brochure, 5, pgs., May 2002.

Gold Line Brochure "Information on New Safety & Security Test and Measurement System", 4 pgs., May 2002.

Jacob, Kenneth, "Understanding Speech Intellilgibility and the Fire Alarm Code", National Fire Protection Association Congress, Anahem, CA, 25 pgs., May 14, 2001.

Steeneken, Herman et al., "Development of an Accurate, Handheld, Simple-to-use Meter for the Prediction of Speech Intelligibility", 11 pgs., presented at Reproduced Sound 17, Stratford-on-Avon, Nov. 16, 2001.

Steeneken, Herman, "The Measurement of Speech Intelligibility", 8 pgs., May 2002.

Letter from Herman J.M. Steeneken to Gregory J. Miller, Esq. TEF Division of Gold Line, May 2002.

"Intelligibility Scores at Gillette Stadium", Feb. 2003 edition of Systems Contractor News, 5 pgs.

* cited by examiner

INTELLIGIBILITY MEASUREMENT OF AUDIO ANNOUNCEMENT SYSTEMS

FIELD OF THE INVENTION

The invention pertains to systems and methods of evaluating the quality of audible output provided to assist or inform individuals in a region. More particularly, the intelligibility of provided audio is evaluated by sensing a plurality of predetermined audible outputs, from an audio output transducer, and, evaluating intelligibility thereof on a per region basis.

BACKGROUND

It has been recognized that speech being projected or transmitted into a region is not necessarily intelligible merely because it is audible. In many instances such as sports stadiums, airports, public buildings and the like, speech delivered into a region may be loud enough to be heard but it may be unintelligible. Such considerations apply to audio announcement systems in general as well as those which are associated with fire safety, building or regional monitoring systems.

Relative to the latter, it has been known to conduct intelligibility testing in connection with such systems by having an installer or technician walk through a building or region being evaluated and listen to output from various speakers of the public address or alarm evacuation system to assess the intelligibility of the instructions or information being output by such devices. In an alternate mode, portable intelligibility analyzers can be carried through the building to each region of interest to provide a quantitative measure of speech intelligibility.

It also has been recognized that testing as described above requires that the installer or technician must literally move through most of the building or region being evaluated to listen or measure the intelligibility of speech signals being delivered in each region. This process is not only time consuming but expensive especially in large buildings. Additionally, when a floor or a portion of the region is being redecorated or built out for a different tenant, that portion of the building or region must be re-evaluated after the construction and/or build out has been completed.

It would be desirable to in some way make use of some or all of the existing equipment of such systems to improve intelligibility testing/evaluation. In such event, more frequent evaluation/testing could be conducted throughout the region or building monitored.

It also has been recognized that there is a benefit in moving from subjective evaluation of the intelligibility of speech in a region toward a more quantitative approach which, at the very least, provides a greater degree of repeatability. A standardized speech transmission index, STI, has been developed for use in evaluating speech intelligibility automatically and without any need for human interpretation of the speech intelligibility.

In STI-type of testing a noise or noise-like signal is amplitude modulated at various rates. The signal is transmitted from a source, such as a loud speaker, into a portion of a region of interest. The signals are detected, for example by a microphone. The received signals are analyzed by comparing the depth of modulation thereof with that of the test signal in each of the frequency bands. Reductions in modulation depth of received signals are associated with loss of intelligibility.

Details of STI-type evaluations have been published and are available for example in "The Modulation Transfer Function In Room Acoustics as a Predictor of Speech Intelligibility" by Steeneken and Houtgast, Acustica V28, PG66-73 (1973) and "A Review of the MTF Concept in Room Acoustics and its Use for Estimating Speech Intelligibility in Auditoria" by Steeneken and Houtgast, Institute for Perception TNO, Soesterberg, the Netherlands (1984).

The above described evaluation process can be carried out by any one of a variety of publicly available analysis programs as would be available to those of skill in the art. One such program has been disclosed and discussed in an article, "The Speech Transmission Index Program is Up and Running", Lexington Center and School for the Deaf, V3.1 (Sep. 9, 2003). Other, earlier programs for evaluating STI are available as would be known to those of skill in the art.

There thus continues to be on ongoing need for improved, more efficient, intelligibility testing in connection with fire safety/evacuation systems. It would be desirable if the recognized benefits of Speech Transmission Index-type processing could be incorporated into such systems to improve intelligibility testing thereof. It would be also desirable to be able to incorporate such functional capability in a way that takes advantage of sensors which are intended to be distributed through a region being monitored so as to minimize additional installation cost and/or equipment needs. Preferably such functionality could not only be incorporated into the sensors being currently installed, but also could be cost effectively incorporated as upgrades in existing systems.

DETAILED DESCRIPTION OF THE PREFERRED EMBODIMENT

Figure 1:
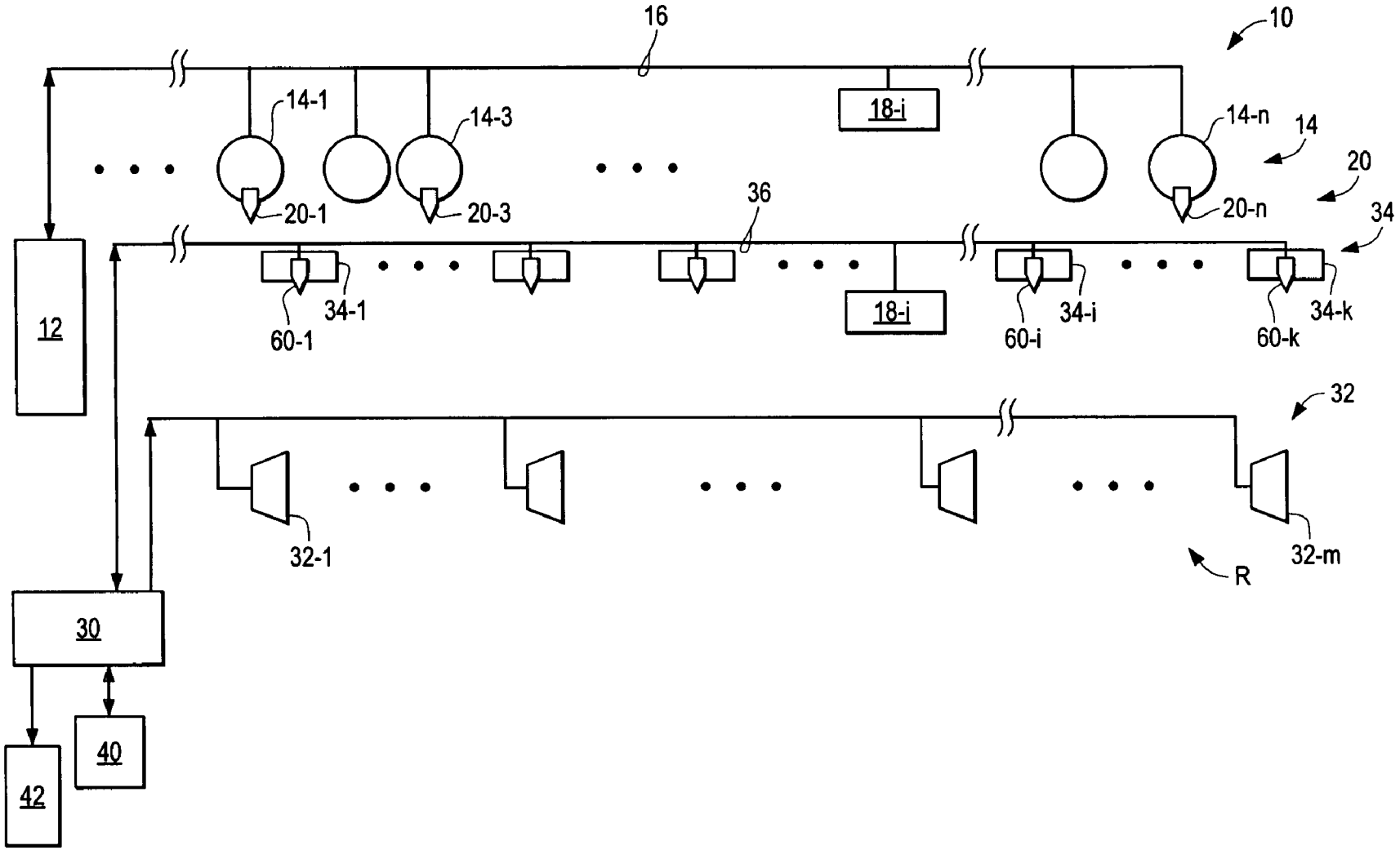
FIG. 1 is a block diagram of a system in accordance with the invention.

While this invention is susceptible of an embodiment in many different forms, there are shown in the drawing and will be described herein in detail specific embodiments thereof with the understanding that the present disclosure is to be considered as an exemplification of the principals of the invention. It is not intended to limit the invention to the specific illustrated embodiments.

In accordance with the invention, intelligibility testing can be incorporated or embedded in hardware associated with audio announcement systems. In one embodiment, one or more microphones can be located throughout a region or building being evaluated. Circuitry associated with the respective microphones can carry out STI-type measurement processing of audio received from one or more speakers, which would be associated with building or regional audio announcement systems.

In one aspect, to carry out an intelligibility test, a sequence of STI test signals, Rapid Speech Transmission Index Test Signals, RASTI, or Speech Intelligibility Index, SII, test signals, ANSI standard S3.5-1997, are delivered from one or more loudspeakers. The received signals can be evaluated using STI-type processing, or any of the other available types of processing, locally at one or more of the microphones. Alternately, the signals can be coupled to a common location for analysis.

Where the analysis is conducted at least in part locally at the respective microphone or microphones, the calculated STI index or other index, can be transmitted either by cable or wirelessly to a control console for operator review and evaluation. Where the respective index values are inadequate, the operator can be notified using a graphical user interface or the like.

The system enables an operator, from a common control console, to test speech intelligibility throughout the building or region or only in certain zones at any given time. Additionally, regular testing can be scheduled and carried out automatically during off peak hours such as overnight, on weekends, and the like.

FIG. 1 illustrates a system 10, which could be a fire alarm system of a known type usable for monitoring a region R. The system 10 includes common control circuitry or a fire alarm control panel 12. The system 10 can include a plurality of ambient condition detectors 14. The detectors 14 could for example be smoke detectors, thermal detectors or gas detectors or combinations thereof all without limitation. Those of skill in the art would understand the specific types of structures which are available to implement such detectors. Units such as unit 18-*i* represent local processing modules, discussed subsequently.

The detectors 14 are in communication with the control circuitry 12 via a wired or wireless medium indicated generally as 16. In one embodiment, some of the detectors, such as 14-1, 14-3 and 14-*n* also include an audio transducer, such as a microphone or microphones indicated generally as 20-1, 20-3 and 20-*n*. The microphones 20-1 . . . 20-*n* could be incorporated in only some or in all of the detectors 14.

As discussed in more detail subsequently, signals received via microphones 20-1 . . . 20-*n* could be processed partially or completely at the respective detector 14-1 . . . 14-*n*. Alternatively, some or all of the processing could be carried out at various system nodes or modules 18-*i* or at control circuitry 12. It will be understood that signals from microphones 20-1 . . . 20-*n* could be transmitted in a variety of ways, via medium 16, to control circuitry 12 all without limitation.

Region R can also incorporate an audio announcement system 30 which could be coupled to or be a part of the control circuitry 12, indicated in phantom. The audio announcement system 30 incorporates one or more loud speakers 32-1 . . . 32-*m* located throughout the region R. The speakers 32-1 . . . 32-*m* could be used, as would be understood by those of skill in the art, for audibly outputting routine messages to people working or present in the region R. Alternately, the speakers 32-1 . . . 32-*m* could be used, in connection with system 10 to advise individuals in the region R of a hazardous condition, such as a fire or the like and provide information and instructions thereto.

System 30 also can include coupled thereto a one or more units 34 such as units 34-1 . . . 34-*k* located throughout the region R in addition to or in lieu of the detector(s) 14. Units 34 can be coupled to system 30 and/or the alternative processing nodes by a wired or wireless medium 36. Units 34 include one or more microphones 60, such as microphone 60-*i*

A source of test signals 40 could be coupled to audio announcement system 30 either acoustically or electrically, without limitation, to provide intelligibility test signals to be output via speakers 32 throughout the region R. The test signals could be, for example, STI-type test signals, RASTI, SII test signals, subsets thereof or other types of standardized test signals usable to evaluate intelligibility as would be understood by those of skill in the art.

In response to the output from the speakers 32, microphones 20, 60, receive audio input corresponding thereto based on their respective physical relationships with the members of the plurality 32. The microphones 20, 60 could also be coupled to local processing circuitry such as units 18-*i* to formulate, at each location, an STI value, an RASTI value, an SII value or any other type of index value without limitation.

The respective index values can be determined at the respective microphone locations and transmitted via media such as medium 16 or 36 respectively to control circuits 12 and/or audio announcement system 30. The respective indices can be presented, for example on or at graphical display 42 for review by operational personnel. Graphical display 42 may communicate with various parts of the system via wired or wireless connection.

Alternately, some or all of the index related processing could be carried out at control circuit 12 or system 30 without departing from the spirit and scope of the invention. In such an embodiment, signals from the microphones could be digitized and transmitted using a digital protocol to circuit 12 or system 30.

The above described intelligibility testing process can be carried out automatically throughout the region R at any appropriate time and the results presented to the operation personnel subsequently. It also has the advantage that if the space in the region R is in part reconfigured, the process can be again initiated and carried out to determine or establish the intelligibility of audio throughout the revised portion of the region R. Additionally, because the testing involves interactions between audio from speakers 32 which is in turn sensed by microphones 20, 60 no operating personnel need travel through the region R as part of the test process. Finally, the speech intelligibility indices provide a quantitative assessment of intelligibility and eliminate any subjective influences which may be present where individuals are attempting to evaluate intelligibility based on their own perceptions.

It will also be understood that none of the exact details of the units or components such as detectors 14, 34, local processing nodes or modules, such as module 18-*i*, microphones 20, 60 or speakers 32 represent limitations of the present invention. Similarly, the numbers of such devices are also not limitations of the present invention. Finally, the location of the intelligibility index processing, which can in part be located at each of the respective detectors 14, local processing node 18, or, at the control circuits 12 or audio announcement system 30, all without limitation, is not a limitation of the invention.

Figure 2A:
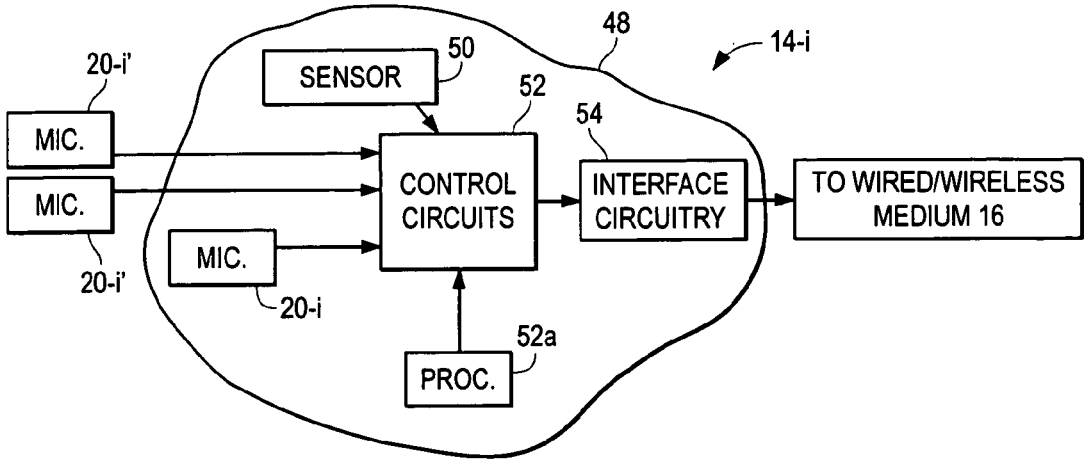
FIG. 2A is a block diagram illustrative of a module incorporating one or more ambient condition sensors and one or more microphones in accordance with the invention.

FIG. 2A, a block diagram illustrates additional details of a representative detector 14-*i* having a housing 48 which carries a microphone 20-*i* and provisions for connections to several optional external microphones such as microphones 20-*i*′. Housing 48 can be mounted on or adjacent to a selected surface in region R. Detector 14-*i* includes at least one ambient condition sensor 50 which could be implemented as a smoke sensor, a flame sensor, a thermal sensor, a gas sensor or a combination thereof.

Outputs from sensor 50 and microphone(s) 20-, 20-*i*′, are coupled to control circuitry 52 which could be implemented, in part, with hard wired circuits or a processor for executing pre-configured instructions or logic 52*a*. Instructions 52*a* could include processing instructions for establishing a speech intelligibility index, STI, RASTI, or SII, or subsets thereof, all without limitation in response to incoming audio sensed at microphone at 20-*i*.

Outputs from circuits 52 can include indices indicative of outputs from sensor 50 as well as microphone 20-*i* or, the processed intelligibility indices in whatever form is preferred. Those outputs are coupled via interface circuitry 54 to wired or wireless medium 16 for transmission to control system or fire alarm control panel 12. It will also be understood that the interface 54 can carry out bi-directional communication between the medium 16 and the detector 14-*i* if desired, all without limitation.

Figure 2B:
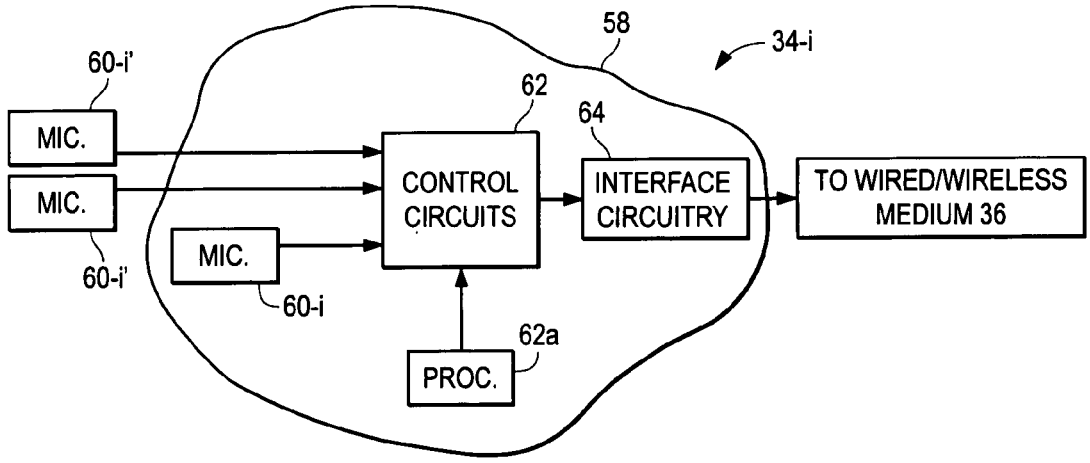
FIG. 2B is a block diagram of an exemplary module incorporating one or more microphones in accordance with the invention.

FIG. 2B illustrates, in block diagram form, a member 34-*i* of the plurality 34. Module 34-*i* includes a housing 58 which is mountable on a selected surface in the region R. Housing 58 may include a microphone, such as microphone 60-*i* and provisions for connections to several optional external microphones 60-*i'* which are in turn coupled to control circuits 62. Circuits 62 could include both hard wired circuits and/or a processor for executing pre-stored instructions or logic 62*a*, as desired, for carrying out speech intelligibility processing and producing an intelligibility index locally to the module 34-*i*. The control circuits 62 can in turn transfer the generated intelligibility index, via interface circuit 64 and medium 36 to system 30 for analysis and presentation as desired on display 42, for example.

Figure 2C:
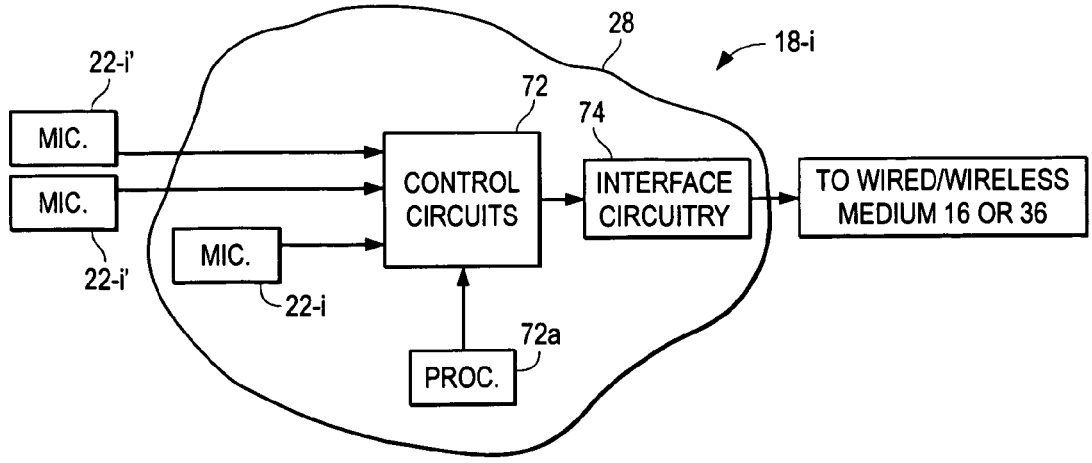
FIG. 2C is a block diagram of an exemplary local processing module.

FIG. 2C is a block diagram of a local processing node or module 18-*i*. Previously described components have been assigned the same identification numeral. The node or module 18-*i* could be coupled to either of media 16, 36 as desired. Local circuitry and software carry out speech index processing in response to received audio. The nodes or modules 18-I could also carry out processing of signals received at other units such as units 14 or 34. Control circuits 72, which include software and/or other circuitry 72*a* process received audio and generate a quantitative output(s) as to quality thereof, as described above. They can communicate via interface circuits 74.

It will be understood that the implementations illustrated for modules 14-*i* and 34-*i* are exemplary only. Variations can be incorporated therein, as would be understood by those of skill in the art, depending on the specific application all without departing from the spirit and scope of the present invention. Among other variations, the microphones are exemplary only. Other forms of audio input transducers come within the spirit and scope of the invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A system comprising:

a plurality of loud speakers that emit intelligibility test signals throughout a region;

a plurality of fixedly mountable microphones that receive audio input corresponding to the intelligibility test signals based upon their respective physical relationship with the members of the plurality of speakers;

circuits coupled to respective microphones including circuitry that automatically detects a received signal at a predetermined time, analyzes the received signal by comparing a depth of modulation thereof with a test signal in each of a plurality of frequency bands, evaluates intelligibility of audio received by the respective microphones based upon the comparative depth of modulation where reduction in modulation depth of the received signal is associated with loss of intelligibility and generates an indicator of intelligibility on a per microphone basis, the circuits each include a network output port and which includes a plurality of ambient condition detectors with at least some of microphones carried by respective ones of the detectors.

2. A system as in claim 1 where at least some of the circuits are carried by respective ones of the detectors coupled to respective microphones also carried by the same detector.

3. A system comprising:

a plurality of audio output devices that audibly produce speech intelligibility test signals throughout an associated geographic region;

a plurality of fixedly mountable microphones, each of the microphones is capable of receiving audio corresponding to the speech intelligibility test signals in the associated geographic region in which that microphone is located based upon the physical relationship of the microphone with respective members of the plurality of audio output devices;

circuits coupled to respective microphones including circuitry that automatically detects a received signal at a predetermined time, that analyzes the received signal by comparing a depth of modulation thereof with a test signal in each of a plurality of frequency bands, that evaluates intelligibility of audio received by the respective microphones based upon the comparative depth of modulation where reduction in modulation depth of the received signal is associated with loss of intelligibility and that generates an indicator of intelligibility on a per microphone basis, the circuits each include a network output port and circuitry that produces prestored speech intelligibility test signals.

4. A system as in claim 3 which includes control circuits coupled to the microphones and the audio output devices, the control circuits couple electrical representations of the speech intelligibility test signals to the output device.

5. A system as in claim 4 which includes the plurality of audio output devices coupled the control circuits.

6. A system comprising:

a plurality of loud speakers that emit intelligibility test signals throughout an associated region;

a plurality of fixedly mountable microphones, each of the microphones is capable of receiving audio corresponding to the intelligibility test signals in the associated geographic region in which that microphone is located based upon a physical relationship of the microphone with respective loud speakers of the plurality of loud speakers;

circuits coupled to respective microphones including circuitry that automatically detects a received signal of the intelligibility test signals at a predetermined time, analyzes the received signal by comparing a depth of modulation thereof with a test signal in each of a plurality of frequency bands, evaluates intelligibility of audio received by the respective microphones based upon the comparative depth of modulation where reduction in modulation depth of the received signal is associated with loss of intelligibility and generates an indicator of intelligibility on a per microphone basis, the circuits each include a network output port; and a plurality of distributed detectors of airborne ambient conditions.

7. A system as in claim 6 where at least some of the detectors carry respective ones of the microphones and the detectors are selected from a class which includes smoke detectors and gas detectors.

8. A system comprising:

a plurality of loud speakers that emit intelligibility test signals throughout an associated region;

a plurality of fixedly mountable microphones, each of the microphones is capable of receiving audio corresponding to the intelligibility test signals in the associated geographic region in which that microphone is located based upon a physical relationship of the microphone with respective loud speakers of the plurality of loud speakers;

circuits coupled to respective microphones including circuitry that automatically detects a received signal of the intelligibility test signals at a predetermined time, analyzes the received signal by comparing a depth of modulation thereof with a test signal in each of a plurality of frequency bands, evaluates intelligibility of audio received by the respective microphones based upon the comparative depth of modulation where reduction in modulation depth of the received signal is associated with loss of intelligibility and generates an indicator of intelligibility on a per microphone basis, the circuits each include a network output port and control circuits which include at least one of logic or executable instructions for producing speech intelligibility test signals to be audibly output by at least one audio output device that is separate from the microphones.

9. A system as in claim 8 which includes additional logic or executable instructions for processing the speech intelligibility test signals received from the respective microphones.

10. A method comprising:

automatically generating and providing at least one machine generated speech intelligibility test signal via a plurality of loud speakers throughout a region at a predetermined time;

automatically sensing the speech intelligibility test signal in a plurality of fixed locations based upon a physical relationship of each of the fixed locations with respective loud speakers of the plurality of loud speakers at the predetermined time;

detecting the sensed signal, analyzing the detected signal by comparing a depth of modulation thereof with the test signal in each of a plurality of frequency bands, and evaluating the intelligibility of the sensed speech intelligibility test signal based upon the comparative depth of modulation where reduction in modulation depth of the sensed test signal is associated with loss of intelligibility.

11. A method as in claim 10 which includes generating a plurality of speech intelligibility test signals.

12. A method as in claim 10 which includes sensing the speech intelligibility test signal at a plurality of spaced apart, fixed locations.

13. A method as in claim 12 which includes:

transmitting the sensed speech intelligibility test signal from the plurality of locations to a common site and then processing same to evaluate intelligibility thereof.

14. A method as in claim 13 where the processing at the common site includes visually presenting processing results.

15. A method as in claim 13 where the sensed speech intelligibility test signals receive initial processing prior to being coupled to the common site.

16. A method as in claim 15 with the initial processing conducted on a per location basis and where initially processed results are each indicative of intelligibility of received audio.

17. An apparatus comprising:

a plurality of ambient airborne condition sensors;

respective control circuits coupled to each of the sensors;

a plurality of loud speakers that emit intelligibility test signals throughout an associated region; and a respective microphone associated with each of the ambient airborne condition sensors that receives signals corresponding to the intelligibility test signal at audible frequencies coupled to the control circuits, where the control circuits automatically detect received signals based upon a physical relationship of the microphone to respective loud speakers of the plurality of loud speakers at a predetermined time, analyze the received signals by comparing a depth of modulation thereof with a test signal in each of a plurality of frequency bands, and establish an intelligibility index based upon the comparative depth of modulation in response to signals from the microphone where reduction in modulation depth of the received signals is associated with loss of intelligibility.

18. An apparatus as in claim 17 which provides at least one port for connection of external microphones.

19. An apparatus as in claim 17 which includes a network communications port.

20. An apparatus as in claim 19 where the intelligibility index comprises at least one of STI, RASTI, SII, or, a subset of one of STI, RASTI, SII.

21. An apparatus as in claim 17 where the ambient condition sensor comprises at least one of a smoke sensor, a flame sensor or a gas sensor.

22. An apparatus as in claim 21 where the control circuits include a processor with logic or executable instructions for carrying out intelligibility index processing.

23. An apparatus as in claim 22 which includes a network communications port, the port facilitating coupling electrical energy to at least the control circuits, and coupling intelligibility indices at least from the control circuits to a medium.

24. An apparatus as in claim 23 where the communications port includes an interface for carrying out bi-directional communication via a medium.

25. An apparatus as in claim 24 where the interface includes circuits coupled to at least one of an electrical cable or an optical cable.

26. A system comprising:

control circuits for automatically producing prestored electrical representations of speech intelligibility test signals at a predetermined time;

a plurality of audible output devices coupled to the control circuits to audibly emit the speech intelligibility test signals throughout an associated geographic region;

a plurality of spaced apart acoustic sensors, each of the acoustic sensors is capable of receiving audio corresponding to the speech intelligibility test signals in the associated geographic region in which that acoustic sensor is located based upon a physical relationship of each of the plurality of spaced apart acoustic sensors to respective audible output devices of the plurality of audio output devices; and circuits coupled to respective acoustic sensors including circuitry that automatically detects the received audio at the predetermined time, analyzes the received audio by comparing a depth of modulation thereof with a test signal in each of a plurality of frequency bands, evaluates intelligibility of audio audible test signals received by the respective acoustic sensors based upon the comparative depth of modulation where reduction in modulation depth of the received audio is associated with loss of intelligibility and generates an indicator of intelligibility on a per acoustic sensor basis, wherein the at least one audible output device is separate from the acoustic sensors.

27. A system as in claim 26 which includes a plurality of distributed ambient condition detectors.

28. A system as in claim 26 where the control circuits include executable instructions for producing speech intelligibility test signals to be audibly output by the at least one audio output device.

29. A system as in claim 28 which includes additional executable instructions for processing the speech intelligibility test signals received from the respective sensors.

30. A system comprising:

control circuits for producing electrical representations of speech intelligibility test signals;

a plurality of audible output devices coupled to the control circuits to automatically audibly emit the speech intelligibility test signals throughout a region at a predetermined time;

a plurality of spaced apart acoustic sensors, the acoustic sensors receive the speech intelligibility test signals based upon a physical relationship of each of the spaced apart acoustic sensors with respective audible output devices of the plurality of audible output devices;

circuits coupled to respective acoustic sensors including circuitry that automatically detects the received signals at the predetermined time, analyze the received signals by comparing a depth of modulation with the test signals in each of a plurality of frequency bands, evaluate intelligibility of audio received by the respective acoustic sensors based upon the comparative depth of modulation where reduction in modulation depth of the received signals is associated with loss of intelligibility and generate an indicator of intelligibility on a per acoustic sensor basis; and a plurality of smoke detectors, where at least some of the detectors carry respective ones of acoustic sensors.

31. An apparatus comprising:

a source of pre-stored intelligibility test signals;

a plurality of loud speakers coupled to the source so as to broadcast selected test signals throughout an associated region at a predetermined time;

a plurality of microphones which are separate from the plurality of loud speakers and which receive at least some of the broadcast test signals, each of the microphones in the plurality is capable of receiving audio in the associated geographic region in which that microphone is located based upon a physical relationship of each of the plurality of microphones with respective loud speakers of the plurality of loud speakers; and at least one detection circuit coupled to a respective microphone that automatically detects the received signals at the predetermined time, analyzes the received signals by comparing a depth of modulation thereof with the broadcast test signal in each of a plurality of frequency bands, generates a speech intelligibility indicium associated with the respective microphone based upon the comparative depth of modulation where reduction in modulation depth of the received signals is associated with loss of intelligibility and that transmits that indicium via a medium to a displaced site.

32. An apparatus as in claim 31 which includes;

a plurality of smoke detectors where at least one microphone is carried by a respective detector and coupled thereto.

* * * * *